US010144060B2

(12) United States Patent
Watanabe et al.

(10) Patent No.: US 10,144,060 B2
(45) Date of Patent: Dec. 4, 2018

(54) SILVER NANOPARTICLES

(71) Applicant: NISSHIN ENGINEERING INC., Tokyo (JP)

(72) Inventors: Shu Watanabe, Tokyo (JP); Keitaroh Nakamura, Fujimino (JP); Shiori Sueyasu, Fujimino (JP)

(73) Assignee: Nisshin Engineering Inc., Tokyo (JP)

( * ) Notice: Subject to any disclaimer, the term of this patent is extended or adjusted under 35 U.S.C. 154(b) by 0 days.

(21) Appl. No.: 15/527,947

(22) PCT Filed: Nov. 20, 2015

(86) PCT No.: PCT/JP2015/082725

§ 371 (c)(1),
(2) Date: May 18, 2017

(87) PCT Pub. No.: WO2016/080528

PCT Pub. Date: May 26, 2016

(65) Prior Publication Data

US 2018/0117673 A1 May 3, 2018

(30) Foreign Application Priority Data

Nov. 21, 2014 (JP) ..... 2014-236608

(51) Int. Cl.

| | |
|---|---|
| ***B22F 1/00*** | (2006.01) |
| ***B22F 1/02*** | (2006.01) |
| ***B22F 9/02*** | (2006.01) |
| ***B22F 9/08*** | (2006.01) |

(52) U.S. Cl.

CPC ..... *B22F 1/0062* (2013.01); *B22F 1/00* (2013.01); *B22F 1/0044* (2013.01); *B22F 1/02* (2013.01); *B22F 9/02* (2013.01); *B22F 9/082* (2013.01); *B22F 2202/13* (2013.01); *B22F 2301/255* (2013.01)

(58) Field of Classification Search

CPC ..... B22F 1/0062; B22F 1/0044; B22F 9/082; B22F 2202/13; B22F 2301/255

USPC ..... 428/403

See application file for complete search history.

(56) References Cited

U.S. PATENT DOCUMENTS

| | | | | |
|---|---|---|---|---|
| 2007/0084308 | A1* | 4/2007 | Nakamura | B22F 9/14 75/346 |
| 2013/0334470 | A1* | 12/2013 | Kurihara | B22F 1/02 252/514 |

FOREIGN PATENT DOCUMENTS

| | | | |
|---|---|---|---|
| JP | 2007-138287 | * | 6/2007 |
| JP | 2007-138287 | A | 6/2007 |
| JP | 2011-236453 | * | 11/2011 |
| JP | 2011-236453 | A | 11/2011 |
| JP | 4963586 | B2 | 6/2012 |
| JP | 2012-162767 | A | 8/2012 |
| JP | 2014-55332 | * | 3/2014 |
| JP | 2014-055332 | A | 3/2014 |
| JP | 2014-098186 | A | 5/2014 |

* cited by examiner

*Primary Examiner* — Leszek B Kiliman

(74) *Attorney, Agent, or Firm* — Muncy, Geissler, Olds & Lowe, P.C.

(57) ABSTRACT

In the present invention, a fine silver particle has a particle diameter of 65-80 nm and has, on the surface of the particle, a thin film comprising a hydrocarbon compound. The fine silver particle has an exothermic peal temperature of 140-155° C. in differential thermal analysis. If d denotes the particle diameter after firing at a temperature of 100° C. for one hour and D denotes the particle diameter before firing, it is preferable for the fine silver particle to have a particle growth rate, as represented by (d−D)/D (%), of 50% or higher.

2 Claims, 6 Drawing Sheets

SILVER NANOPARTICLES

TECHNICAL FIELD

The present invention relates to silver nanoparticles that can be used for various devices such as solar cells and light emitting devices, conductive pastes, electrodes of electronic components such as laminated ceramic capacitors, wiring on printed circuit boards, wiring of touch panels, flexible electronic paper and the like, and particularly to silver nanoparticles that can be baked at a low temperature and have a small particle size.

BACKGROUND ART

At present, various types of nanoparticles have been used in many applications. For example, nanoparticles such as metal nanoparticles, oxide nanoparticles, nitride nanoparticles and carbide nanoparticles are used in the production of sintered bodies for use as electrical insulation materials for semiconductor substrates, printed circuit boards, various electrical insulation parts and the like, materials for high-hardness and high-precision machining tools such as cutting tools, dies and bearings, functional materials for grain boundary capacitors, humidity sensors and the like, and precision sinter molding materials, and in the production of thermal sprayed parts such as engine valves made of materials that are required to be wear-resistant at a high temperature, as well as in the fields of electrode or electrolyte materials and various catalysts for fuel cells.

It is known that among various nanoparticles, silver nanoparticles are used for various devices such as solar cells and light emitting devices, conductive pastes, electrodes for electronic components such as laminated ceramic capacitors, wiring on printed circuit boards, wiring on touch panels, flexible electronic paper and the like. Silver electrodes and silver wiring can be obtained through the process of baking silver nanoparticles. Silver nanoparticles and production methods thereof are disclosed by Patent Literatures 1 and 2, for example.

Patent Literature 1 describes the ultrafine particle producing process that introduces and disperses materials for producing ultrafine particles into a thermal plasma flame under reduced pressure using an inert gas as a carrier gas to form a vapor-phase mixture, introduces a gas mixture of hydrocarbon gas and a cooling gas other than the hydrocarbon gas in a supply amount sufficient for quenching the vapor-phase mixture toward an end portion (tail portion) of the thermal plasma flame at an angle of more than 90° but less than 240° with a perpendicular direction parallel to the thermal plasma flame and at an angle of more than −90° but less than 90° with respect to the central portion of the thermal plasma flame in a plane orthogonal to the perpendicular direction of the thermal plasma flame to generate ultrafine particles, and allows the generated ultrafine particles to come into contact with the hydrocarbon gas so as to produce the ultrafine particles whose surfaces are coated with a thin film formed of a hydrocarbon compound. Patent Literature 1 describes that ultrafine silver particles are produced using the above-described production method.

Patent Literature 2 describes silver powder having a D50 value of 60 nm to 150 nm as determined by the image analysis of a scanning electron microscope (SEM) image, having a carbon (C) content of less than 0.40 wt % as determined in accordance with JIS Z 2615 (General rules for determination of carbon in metallic materials), and comprising spherical or almost-spherical silver powder particles.

Patent Literature 2 teaches that the silver powder can be sintered at a temperature of 175° C. or lower.

CITATION LIST

Patent Literature

Patent Literature 1: JP 4963586 B
Patent Literature 2: JP 2014-098186 A

SUMMARY OF INVENTION

Technical Problems

Patent Literature 1 describes the process for producing ultrafine silver particles using plasma as above. Patent Literature 2 describes silver powder having a specified D50 value and a specific carbon content and teaches that the silver powder can be sintered at a temperature of 175° C. or lower. For the future, there are demands for silver nanoparticles capable of being baked at a lower temperature so that a low heat-resistant substrate can be used and for silver nanoparticles having a so small particle size that fine wiring becomes possible.

An object of the present invention is to solve the above-described problem in the prior art and to provide silver nanoparticles that can be baked at a lower temperature and have a smaller particle size as compared to conventional silver nanoparticles.

Solution to Problems

In order to attain the above object, the present invention provides silver nanoparticles having a particle size of 65 nm to 80 nm, and having a thin film formed of a hydrocarbon compound on surfaces thereof, wherein an exothermic peak temperature in a differential thermal analysis is 140° C. to 155° C.

Preferably, a particle growth rate expressed as (d−D)/D (%) is at least 50%, provided that d refers to a particle size of the silver nanoparticles after being baked at 100° C. for an hour, and D refers to a particle size of the silver nanoparticles before being baked.

Advantageous Effects of Invention

The silver nanoparticles having a thin film formed of a hydrocarbon compound on surfaces thereof according to the present invention can be baked at a lower temperature as compared to the prior art.

DESCRIPTION OF EMBODIMENTS

The silver nanoparticles of the invention will be now described in detail based on a preferred embodiment illustrated in the attached drawings.

The silver nanoparticles of the present invention have a particle size of 65 nm to 80 nm and have a thin film formed of a hydrocarbon compound on surfaces thereof. An exothermic peak temperature in differential thermal analysis of the silver nanoparticles is 140° C. to 155° C. In addition, the silver nanoparticles preferably have a particle growth rate, which is expressed as (d−D)/D %, of at least 50%, provided that a particle size of particles after being baked for an hour at 100° C. is d, and a particle size of particles before being baked is D.

The particle size in the present invention is determined using the BET method and is an average particle size calculated from a specific surface area, based on an assumption that particles are spherical.

As long as an exothermic peak temperature is at least 140° C. and not more than 155° C. in differential thermal analysis, the silver nanoparticles that are baked at 100° C. for an hour, for example, bond to one another to coarsen or exhibit metallic luster.

When the silver nanoparticles of the present invention are heated in the atmosphere, the hydrocarbon compound contained in the thin film covering the surfaces of the silver nanoparticles reacts with oxygen in the atmosphere, burns with heat generation, and decomposes. Exothermicity of such heat generation is measured using a thermogravimeter-differential thermal analyzer (TG-DTA), and the temperature at which the highest exothermicity is observed is determined as the exothermic peak temperature (° C.) in differential thermal analysis. Accordingly, the silver nanoparticles having the lower exothermic peak temperature allow the hydrocarbon compound in the thin film covering the surfaces thereof to more easily decompose; the silver nanoparticles from whose surfaces the thin film has disappeared more easily contact with one another, suggesting that such silver nanoparticles can be baked at the lower temperature.

Next, described are the measurement results of the silver nanoparticles of the present invention using a thermogravimeter-differential thermal analyzer (TG-DTA).

Figure 1:
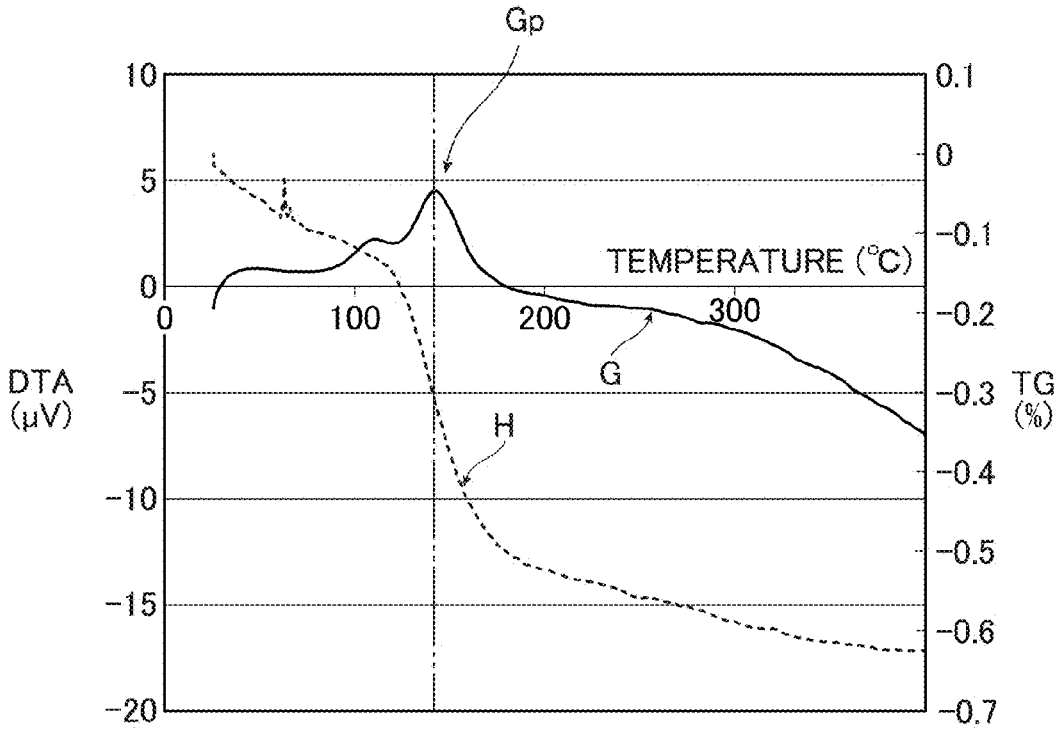
FIG. 1 is a graph showing an example of a thermogravimetric measurement curve and a differential thermal curve of silver nanoparticles having a thin film formed of a hydrocarbon compound on surfaces thereof according to the present invention.

FIG. 1 shows a graph showing an example of a thermogravimetric measurement curve and a differential thermal curve of silver nanoparticles having a thin film formed of a hydrocarbon compound on surfaces thereof according to the present invention. In FIG. 1, a reference sign G refers to a differential thermal curve (DTA), while a reference sign H refers to a thermogravimetric measurement curve (TG). It should be noted that the temperature at which the differential thermal curve G hits the exothermic peak Gp corresponds to the exothermic peak temperature described above.

The thermogravimetric measurement curve H shows the change in weight, and the weight begins to decrease before the exothermic peak Gp of the differential thermal curve G. This fact suggests that moisture and other substances than the hydrocarbon compound evaporate or burn, and that the hydrocarbon compound may also begin to decompose before the exothermic peak Gp of the differential thermal curve G, wherefore the weight decreases.

In addition, the thermogravimetric measurement curve H shows a large inclination near the exothermic peak Gp of the differential thermal curve G, indicating that decomposition has developed therearound. It is indicated that decomposition causes heat generation and creates the exothermic peak Gp of the differential thermal curve G.

The exothermic peak Gp of the differential thermal curve G is not the start of decomposition but occurs when decomposition most develops. The exothermic peak temperature of the differential thermal curve G does not vary unless the type or proportion of hydrocarbon compound generated on the surfaces of the silver nanoparticles changes. In the meantime, if the type and the proportion of the hydrocarbon compound generated on the surfaces of the silver nanoparticles do not change but the weight of the hydrocarbon compound changes, the differential thermal analysis (DTA) value at the exothermic peak temperature changes.

The silver nanoparticles preferably have a particle growth rate, which is expressed as (d−D)/D (%), of at least 50%, provided that the particle size of the silver nanoparticles after being baked at 100° C. in the atmosphere for an hour is d, and the particle size of the silver nanoparticles before being baked is D. The particle growth rate shows the progress of fusion of the silver nanoparticles when the silver nanoparticles are baked at 100° C. for an hour. The silver nanoparticles having a high particle growth rate can be baked at a relatively low temperature like 100° C. and can achieve a high conductivity. Accordingly, the higher particle growth rate is preferable. Meanwhile, when the particle growth rate is at least 50%, fusion of the silver nanoparticles can progress, and the silver nanoparticles can be baked at a relatively low temperature like 100° C. and obtain high conductivity.

On the other hand, if the particle growth rate of the silver nanoparticles after being baked at 100° C. in the atmosphere for an hour is lower than 50%, the progress of fusion of the silver nanoparticles in the baking at 100° C. is small, and there is a possibility that the silver nanoparticles fail to obtain high conductivity. Accordingly, the particle growth rate of the silver nanoparticles after being baked at 100° C. in the atmosphere for an hour is preferably at least 50%. The baking process is carried out by, for example, a furnace which has reached a temperature of 100° C., and in which silver nanoparticles are placed. The ambience in the furnace is atmospheric.

The particle size of the above silver nanoparticles after being baked is defined in a similar manner to that of the particle size in the present invention described above. Accordingly, the detailed description thereabout is omitted.

The silver nanoparticles whose particle size and exothermic peak temperature in the differential thermal analysis are specified as above can be baked at a low temperature.

Next, an example of a method of producing the silver nanoparticles of the present invention will be described.

Figure 2:
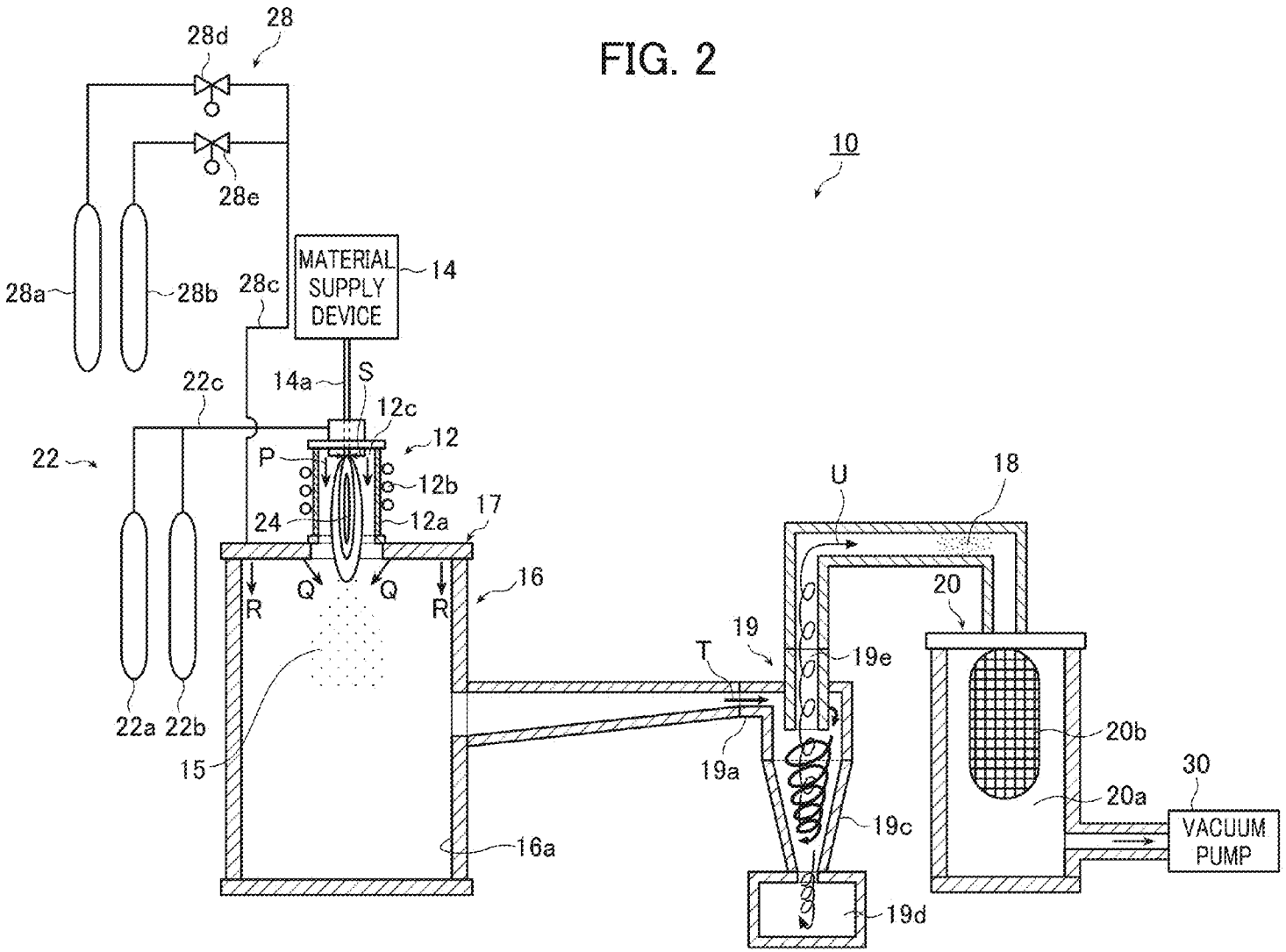
FIG. 2 is a schematic diagram showing an apparatus for producing nanoparticles that is used in a method of producing silver nanoparticles having a thin film formed of a hydrocarbon compound on surfaces thereof according to an embodiment of the present invention.

FIG. 2 is a schematic diagram showing an apparatus for producing nanoparticles that is used in the method of producing the silver nanoparticles having a thin film formed of a hydrocarbon compound on surfaces thereof according to the embodiment of the present invention.

A nanoparticle production apparatus 10 (hereinafter, simply referred to as "production apparatus 10") illustrated in FIG. 2 is used to produce silver nanoparticles.

The production apparatus 10 includes a plasma torch 12 generating thermal plasma, a material supply device 14 supplying a powder material for producing silver nanoparticles into the plasma torch 12, a chamber 16 serving as a cooling tank for producing primary silver nanoparticles 15, a cyclone 19 removing, from the produced primary silver nanoparticles 15, coarse particles having a particle size equal to or larger than an arbitrarily specified particle size, and a collecting section 20 collecting secondary silver nanoparticles 18 having a desired particle size as obtained by classification in the cyclone 19.

As the material supply device 14, the chamber 16, the cyclone 19 and the collecting section 20, those described in JP 2007-138287 A can be used, for example.

In the embodiment, silver powder is used to produce the silver nanoparticles. In order to readily evaporate in a thermal plasma flame, an average particle size of the silver powder is appropriately set and is, for example, up to 100 μm, preferably up to 10 μm and more preferably up to 3 μm.

The plasma torch 12 includes a quartz tube 12*a* and a coil 12*b* for high frequency oscillation surrounding the outside of the quartz tube. On top of the plasma torch 12, a supply tube 14*a* to be described later which is for supplying powder of a raw material for the silver nanoparticles into the plasma torch 12 is provided at the central portion thereof. A plasma gas supply port 12*c* is formed in a peripheral portion of the supply tube 14*a* (on the same circumference). The plasma gas supply port 12*c* is in a ring shape.

A plasma gas supply source 22 is for supplying plasma gas into the plasma torch 12 and has a first gas supply section 22*a* and a second gas supply section 22*b*, which are connected to the plasma gas supply port 12*c* through piping 22*c*. Although not shown, the first gas supply section 22*a* and the second gas supply section 22*b* are each provided with a supply amount adjuster such as a valve for adjusting the supply amount. Plasma gas is supplied from the plasma gas supply source 22 into the plasma torch 12 through the ring-shaped plasma gas supply port 12*c* in a direction indicated by an arrow P and in a direction indicated by an arrow S.

For example, a gas mixture of hydrogen gas and argon gas is used as the plasma gas. In this case, the first gas supply section 22*a* stores hydrogen gas and the second gas supply section 22*b* stores argon gas. Hydrogen gas and argon gas are respectively supplied from the first gas supply section 22*a* and the second gas supply section 22*b* of the plasma gas supply source 22 into the plasma torch 12 in the direction indicated by the arrow P and in the direction indicated by the arrow S after having passed through the plasma gas supply port 12*c* via the piping 22*c*. Here, only argon gas may be supplied in the direction indicated by the arrow P.

When a high frequency voltage is applied to the coil 12*b* for high frequency oscillation, a thermal plasma flame 24 is generated in the plasma torch 12.

It is necessary for the thermal plasma flame 24 to have a higher temperature than the boiling point of the raw material powder. On the other hand, while the thermal plasma flame 24 preferably has a higher temperature because the raw material powder is more easily converted into a gas phase state, there is no particular limitation on the temperature. For example, the thermal plasma flame 24 may have a temperature of 6,000° C., and in theory, the temperature is deemed to reach around 10,000° C.

It is preferable that the ambient pressure inside the plasma torch 12 does not exceed atmospheric pressure. The ambient pressure not exceeding atmospheric pressure is not particularly limited and is, for example, in a range of 0.5 to 100 kPa.

The outside of the quartz tube 12*a* is surrounded by a concentrically formed tube (not shown) and cooling water is circulated between this tube and the quartz tube 12*a* to cool the quartz tube 12*a* with the water, whereby the quartz tube 12*a* is prevented from having an excessively high temperature due to the thermal plasma flame 24 generated in the plasma torch 12.

The material supply device 14 is connected to the upper portion of the plasma torch 12 through the supply tube 14*a*. The material supply device 14 is for supplying, for example, the raw material powder in the form of powder into the thermal plasma flame 24 in the plasma torch 12.

For example, the device disclosed in JP 2007-138287 A may be used as the material supply device 14 which supplies silver powder in the form of powder. In this case, the material supply device 14 includes, for example, a storage tank (not shown) storing silver powder, a screw feeder (not shown) transporting the silver powder in a fixed amount, a dispersion section (not shown) dispersing the silver powder transported by the screw feeder to convert it into the state of primary particles before the silver powder is finally diffused, and a carrier gas supply source (not shown).

Together with a carrier gas to which push-out pressure is applied by the carrier gas supply source, the silver powder is supplied into the thermal plasma flame 24 in the plasma torch 12 through the supply tube 14*a*.

There is no limitation on the structure of the material supply device 14 as long as the material supply device 14 can prevent the silver powder from agglomerating and diffuse the silver powder being kept in a dispersed state in the plasma torch 12. For the carrier gas, for example, an inert gas such as argon gas may be used. A carrier gas flow rate can be controlled using a flowmeter such as a float-type flowmeter, for example. In addition, a flow rate value of carrier gas refers to a value of a scale on the flowmeter.

The chamber 16 is disposed below and adjacent to the plasma torch 12 and is connected to a gas supply device 28. The primary silver nanoparticles 15 are produced in the chamber 16. In addition, the chamber 16 serves as a cooling tank.

The gas supply device 28 supplies cooling gas into the chamber 16. The gas supply device 28 includes a first gas supply source 28*a*, a second gas supply source 28*b* and piping 28*c*, and further includes a pressure application means (not shown) such as a compressor or a blower which applies push-out pressure to the cooling gas to be supplied into the chamber 16. The gas supply device 28 is also provided with a pressure control valve 28*d* which controls the amount of gas supplied from the first gas supply source

28*a* and a pressure control valve 28*e* which controls the amount of gas supplied from the second gas supply source 28*b*. For example, the first gas supply source 28*a* stores argon gas, while the second gas supply source 28*b* stores methane gas ($CH_4$ gas). In this case, the cooling gas is a gas mixture of argon gas and methane gas.

The gas supply device 28 supplies the gas mixture of argon gas and methane gas serving as the cooling gas toward a tale portion of the thermal plasma flame 24, that is, an edge of the thermal plasma flame 24 on the opposite side to the plasma gas supply port 12*c*, that is, an end portion of the thermal plasma flame 24 at an angle of, for example, 45° in a direction of an arrow Q, and also supplies the above-described cooling gas from above and downward along an inner wall 16*a* of the chamber 16, that is, in a direction of an arrow R in FIG. 2.

The silver powder converted into the gas phase state by the thermal plasma flame 24 is quenched by the gas mixture of argon gas and methane gas serving as the cooling gas supplied from the gas supply device 28 into the chamber 16, whereby the primary silver nanoparticles 15 are obtained. Other than the above, the gas mixture of argon gas and methane gas has additional effects such as contribution to classification of the primary silver nanoparticles 15 in the cyclone 19.

When particles of the primary silver nanoparticles 15 that are just produced collide with one another, agglomerates are formed to generate unevenness in particle size; this may become a cause for the quality degradation. Meanwhile, the primary nanoparticles 15 that are diluted by the gas mixture supplied as the cooling gas in the direction of the arrow Q toward the tale portion (end portion) of the thermal plasma flame would be prevented from colliding with one another and agglomerating.

In addition, the gas mixture supplied as the cooling gas in the direction of the arrow R prevents the primary nanoparticles 15 from adhering to the inner wall 16*a* of the chamber 16 in the process of collecting the primary nanoparticles 15, whereby the yield of the produced primary nanoparticles 15 improves.

In the meantime, the gas mixture of argon gas and methane gas used as the cooling gas may further contain hydrogen gas. In this case, a third gas supply source (not shown) and a pressure control valve (not shown) which controls the amount of gas supplied are provided, and the third gas supply source stores hydrogen gas. For example, the hydrogen gas may be supplied in a fixed amount in at least one of the directions of the arrow Q and the arrow R.

As shown in FIG. 2, the cyclone 19 for classifying the produced primary nanoparticles 15 at a desired particle size is provided to the chamber 16. The cyclone 19 includes an inlet tube 19*a* which supplies the primary nanoparticles 15 from the chamber 16, a cylindrical outer casing 19*b* connected to the inlet tube 19*a* and positioned in an upper portion of the cyclone 19, a truncated conical part 19*c* continuing downward from a lower portion of the outer casing 19*b* and having a gradually decreasing diameter, a coarse particle collecting chamber 19*d* connected to a lower side of the truncated conical part 19*c* for collecting coarse particles having a particle size equal to or larger than the above-mentioned desired particle size, and an inner tube 19*e* connected to the collecting section 20 to be described later in detail and mounted on the outer casing 19*b* in a projected manner.

A gas stream containing the primary nanoparticles 15 produced in the chamber 16 is blown from the inlet tube 19*a* of the cyclone 19 along the inner peripheral wall of the outer casing 19*b*, and this gas stream flows in the direction from the inner peripheral wall of the outer casing 19*b* to the truncated conical part 19*c* as indicated by an arrow T in FIG. 2, thereby forming a downward swirling stream.

The foregoing downward swirling stream is inverted to form an upward stream, and, due to the balance between the centrifugal force and drag, coarse particles cannot ride on the upward stream and come down along the side surface of the truncated conical part 19*c* and are collected in the coarse particle collecting chamber 19*d*. Nanoparticles more affected by the drag rather than by a centrifugal force are discharged outside the system through the inner tube 19*e* along with the upward stream on the inner wall of the truncated conical part 19*c*.

In addition, a negative pressure (suction force) is generated by the collecting section 20 to be described below in detail and applied through the inner tube 19*e*. Under the negative pressure (suction force), silver nanoparticles separated from the above-mentioned swirling gas stream are attracted as indicated by a reference sign U and sent to the collecting section 20 through the inner tube 19*e*.

On the extension of the inner tube 19*e*, which is an outlet for the gas stream in the cyclone 19, the collecting section 20 for collecting the secondary nanoparticles (silver nanoparticles) 18 having a desired particle size on the order of nanometers is provided. The collecting section 20 includes a collecting chamber 20*a*, a filter 20*b* provided in the collecting chamber 20*a*, and a vacuum pump 30 connected through a tube provided below inside the collecting chamber 20*a*. The nanoparticles delivered from the cyclone 19 are sucked by the vacuum pump 30 to be introduced into the collecting chamber 20*a*, thereby being collected as remaining on the surface of the filter 20*b*.

In the foregoing production apparatus 10, the number of cyclones to be used is not particularly limited to one but may be two or more.

Next, an example of the method of producing silver nanoparticles using the foregoing production apparatus 10 is described below.

Initially, as the raw material powder for the silver nanoparticles, silver powder having an average particle size of up to 5 μm, for example, is charged into the material supply device 14.

For example, argon gas and hydrogen gas are used as the plasma gas, and a high frequency voltage is applied to the coil 12*b* for high frequency oscillation to generate the thermal plasma flame 24 in the plasma torch 12.

A gas mixture of argon gas and methane gas, for example, is supplied as the cooling gas in the direction of the arrow Q from the gas supply device 28 to the tail portion of the thermal plasma flame 24, i.e., to the end portion of the thermal plasma flame 24. At that time, the gas mixture of argon gas and methane gas is supplied as the cooling gas also in the direction of the arrow R.

Next, the silver powder is transported with a gas, namely, argon gas used as a carrier gas, and supplied into the thermal plasma flame 24 in the plasma torch 12 through the supply tube 14*a*. The supplied silver powder is evaporated into a gas phase state in the thermal plasma flame 24 and quenched by the cooling gas to produce the primary silver nanoparticles 15 (silver nanoparticles).

The primary silver nanoparticles 15 produced in the chamber 16 are blown from the inlet tube 19*a* of the cyclone 19 together with a gas stream along the inner peripheral wall of the outer casing 19*b*, and this gas stream thus flows along the inner peripheral wall of the outer casing 19*b* as indicated by the arrow T in FIG. 2, thereby forming a swirling stream, which goes downward. When the foregoing downward swirling stream is inverted to form an upward stream, due to the balance between the centrifugal force and drag, coarse particles cannot ride on the upward stream and come down along the side surface of the truncated conical part 19*c* and are collected in the coarse particle collecting chamber 19*d*. Nanoparticles affected by the drag rather than by a centrifugal force are discharged outside the system from the inner wall along with the upward stream on the inner wall of the truncated conical part 19*c*.

Under the negative pressure (suction force) from the collecting section 20 as caused by the vacuum pump 30, the discharged secondary nanoparticles (silver nanoparticles) 18 are attracted in the direction indicated by the reference sign U in FIG. 2, delivered to the collecting section 20 through the inner tube 19*e*, and collected on the filter 20*b* of the collecting section 20. The internal pressure of the cyclone 19 at that time is preferably not higher than atmospheric pressure. In addition, the secondary nanoparticles (silver nanoparticles) 18 are specified to be of any particle size on the order of nanometers according to the intended use.

In the embodiment, the silver nanoparticles having a particle size of 65 nm to 80 nm, having a thin film formed of a hydrocarbon compound on surfaces thereof and having the exothermic peak temperature of 140° C. to 155° C. in differential thermal analysis can be readily and assuredly obtained merely through the plasma processing of silver powder in this manner.

In addition, the silver nanoparticles produced by the production method of silver nanoparticles of the embodiment have a narrow particle size distribution, i.e., have evenness in particle size, with very little coarse particles of 1 μm or larger mixed therein.

The present invention is basically constituted as described above. While the silver nanoparticles according to the present invention have been described in detail, the present invention is by no means limited to the foregoing embodiments and it should be understood that various improvements and modifications may be made without departing from the scope of the invention.

EXAMPLES

Examples of the silver nanoparticles of the present invention will be specifically described below.

In examples, silver nanoparticles of Examples 1 to 5 and Comparative Examples 1 to 7 having particle sizes (nm) as shown in Table 1 below were prepared. The silver nanoparticles of Examples 1 to 5 and Comparative Examples 1 to 7 have undergone the differential thermal analysis to find the respective exothermic peak temperatures (° C.). It should be noted that the silver nanoparticles of each of Examples 1 to 5 and Comparative Examples 1 to 6 showed an exothermic peak in the differential thermal analysis and allowed an exothermic peak temperature (° C.) to be found, whereas the silver nanoparticles of Comparative Example 7 did not show an exothermic peak in the differential thermal analysis so that an exothermic peak temperature (° C.) was not found. Hence, Table 1 shows "-" in the cell of the "exothermic peak temperature [° C.]" for the silver nanoparticles of Comparative Example 7. The fact that no exothermic peak temperature is found indicates that the hydrocarbon compound in the thin film covering the surfaces of the silver nanoparticles does not decompose rapidly.

The silver nanoparticles of Examples 1 to 5 and Comparative Examples 1, 6 and 7 were baked at 100° C. in the atmosphere for an hour. The results thereof are shown in Table 1 below. The baking process took place using a furnace which was heated to the temperature of 100° C. and in which the respective silver nanoparticles of Examples 1 to 5 and Comparative Examples 1, 6 and 7 were placed. The ambience in the furnace was atmospheric.

Figure 3A:
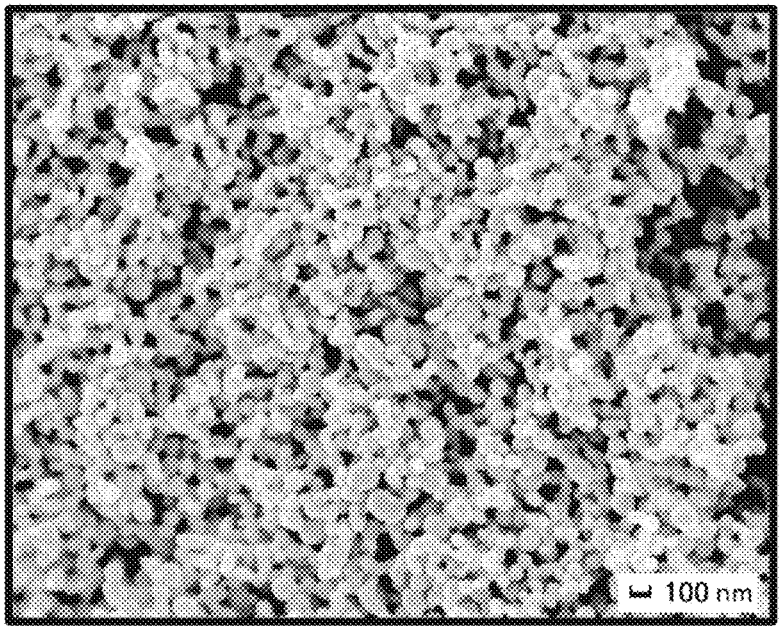
FIG. 3A is a view of a SEM image showing silver nanoparticles having a thin film formed of a hydrocarbon compound on surfaces thereof in Example 4.
Figure 3B:
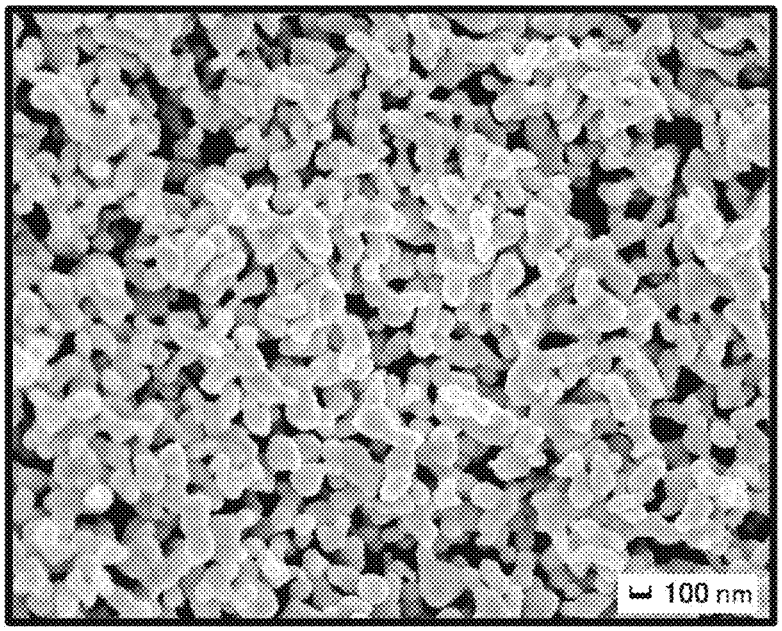
FIG. 3B is a view of a SEM image showing silver nanoparticles having a thin film formed of a hydrocarbon compound on surfaces thereof after being baked in Example 4.

The silver nanoparticles of Example 4, Comparative Examples 1, 6 and 7 were observed before and after being baked, using a scanning electron microscope (SEM). The observed silver nanoparticles of Example 4, Comparative Example 1, Comparative Example 6 and Comparative Example 7 are shown in FIGS. 3A and 3B, in FIGS. 4A and 4B, in FIGS. 5A and 5B and in FIGS. 6A and 6B, respectively.

The silver nanoparticles of Examples 1 to 5 and Comparative Examples 1 to 7 were prepared using the foregoing nanoparticle production apparatus 10.

Silver powder having an average particle size of 5 μm was used as the raw material powder.

Argon gas was used as the carrier gas, while a gas mixture of argon gas and hydrogen gas was used as the plasma gas. In addition, a gas mixture of argon gas and methane gas or a gas mixture of argon gas, hydrogen gas and methane gas was used as the cooling gas. Table 1 below shows the respective gas flow rates inside the chamber, i.e., flow rates of the cooling gas in the chamber.

The particle size of the silver nanoparticles is an average particle size measured using the BET method. The particle size of the silver nanoparticles after being baked is also an average particle size measured using the BET method.

The exothermic peak temperature in the differential thermal analysis was measured using a thermogravimeter-differential thermal analyzer (TG-DTA) in the atmosphere. Thermo plus TG8120 manufactured by Rigaku Corporation was used as the thermogravimeter-differential thermal analyzer (TG-DTA).

TABLE 1

| | Gas flow rate in chamber [m/s] | BET [$m^2/g$] | Particle size ($d_{BET}$) [nm] | Exothermic peak temperature [° C.] | BET after being baked at 100° C. for 1 hour [$m^2/g$] | Particle size after being baked at 100° C. for 1 hour ($d_{BET}$) [nm] | Particle growth rate after being baked at 100° C. for 1 hour [%] |
|---|---|---|---|---|---|---|---|
| Example 1 | 0.639 | 7.9 | 72.6 | 148.8 | 5.1 | 111.7 | 53.9 |
| Example 2 | 0.645 | 8.7 | 65.6 | 147.8 | 4.9 | 117.6 | 79.3 |
| Example 3 | 0.699 | 8.8 | 65.4 | 141.8 | 5.2 | 109.7 | 67.7 |
| Example 4 | 0.693 | 7.5 | 76.4 | 154 | 4.9 | 116.9 | 53.0 |
| Example 5 | 0.693 | 8.1 | 70.7 | 151 | 3.9 | 146.8 | 107.6 |
| Comparative Example 1 | 0.694 | 9.8 | 58.3 | 161.1 | 6.7 | 85.2 | 46.1 |
| Comparative Example 2 | 0.235 | 5.3 | 109 | 156.7 | — | — | — |
| Comparative Example 3 | 0.235 | 5.0 | 115 | 153.9 | — | — | — |
| Comparative Example 4 | 0.240 | 8.1 | 71 | 204.1 | — | — | — |
| Comparative Example 5 | 0.318 | 14.0 | 41 | 169.2 | — | — | — |
| Comparative Example 6 | 0.696 | 7.0 | 81.8 | 165.5 | 5.3 | 107.9 | 31.9 |
| Comparative Example 7 | 0.379 | 6.0 | 95.5 | — | 4.6 | 123.2 | 29.0 |

As shown in Table 1 above, the silver nanoparticles of Examples 1 to 5 increased in particle size after being baked at 100° C. for an hour, as compared to the particle size thereof before being baked, each exhibiting the particle growth rate of at least 50%. Based thereon, it can be understood that the silver nanoparticles have fused and bonded to one another. As to the silver nanoparticles of Example 4, comparison between the silver nanoparticles before being baked shown in FIG. 3A and the silver nanoparticles after being baked shown in FIG. 3B reveals that the silver nanoparticles after being baked increased in particle size and that the silver nanoparticles have fused and bonded to one another.

In the meantime, the silver nanoparticles of Comparative Examples 1, 6 and 7 increased in particle size after being baked at 100° C. for an hour but the particle growth rates thereof were less than 50%; it is unlikely that the silver nanoparticles of Comparative Examples 1, 6 and 7 have fused and bonded to one another.

Figure 4A:
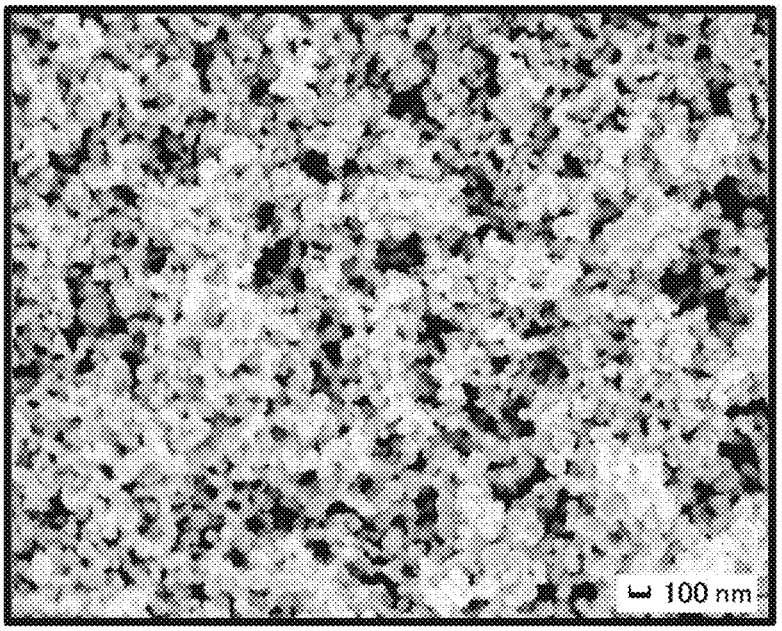
FIG. 4A is a view of a SEM image showing silver nanoparticles having a thin film formed of a hydrocarbon compound on surfaces thereof in Comparative Example 1.
Figure 4B:
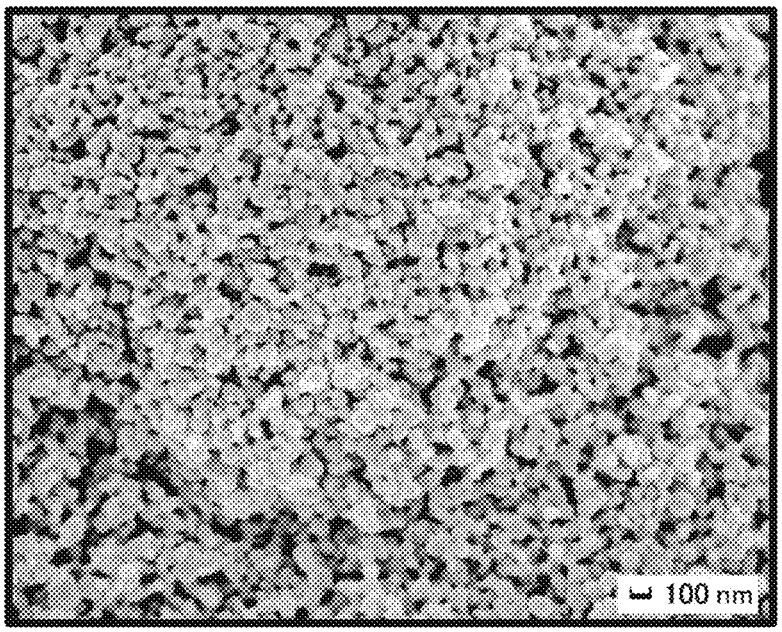
FIG. 4B is a view of a SEM image showing silver nanoparticles having a thin film formed of a hydrocarbon compound on surfaces thereof after being baked in Comparative Example 1.

As to the silver nanoparticles of Comparative Example 1, comparison between the silver nanoparticles before being baked shown in FIG. 4A and the silver nanoparticles after being baked shown in FIG. 4B reveals that the silver nanoparticles after being baked did not increase in particle size and that the particles have not apparently bonded to one another.

Figure 5A:
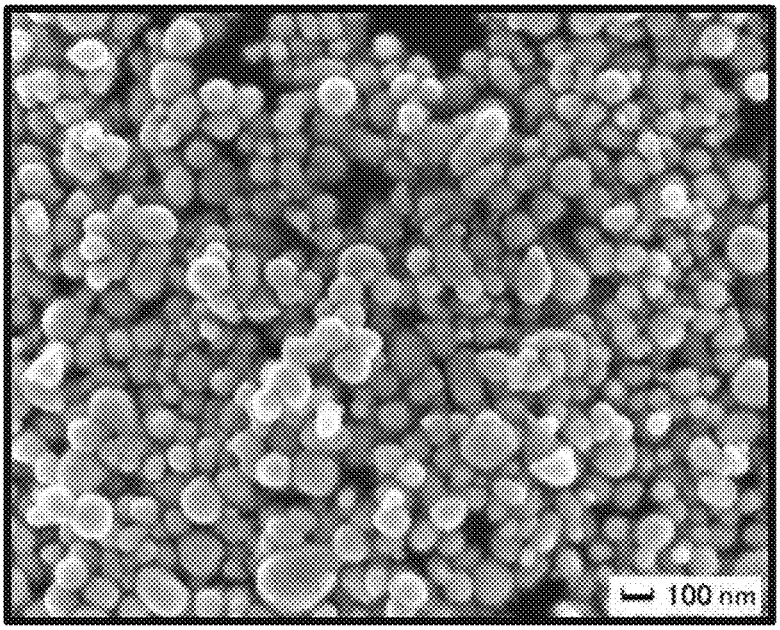
FIG. 5A is a view of a SEM image showing silver nanoparticles having a thin film formed of a hydrocarbon compound on surfaces thereof in Comparative Example 6.
Figure 5B:
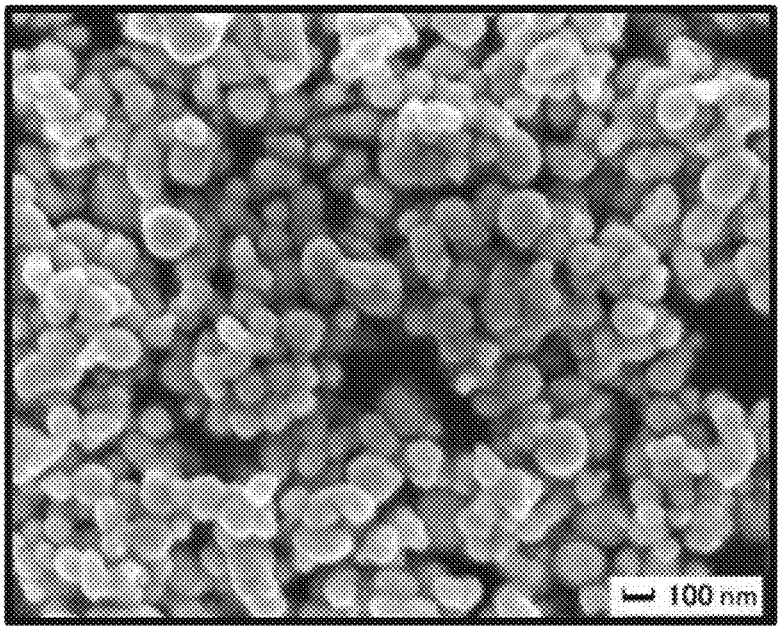
FIG. 5B is a view of a SEM image showing silver nanoparticles having a thin film formed of a hydrocarbon compound on surfaces thereof after being baked in Comparative Example 6.
Figure 6A:
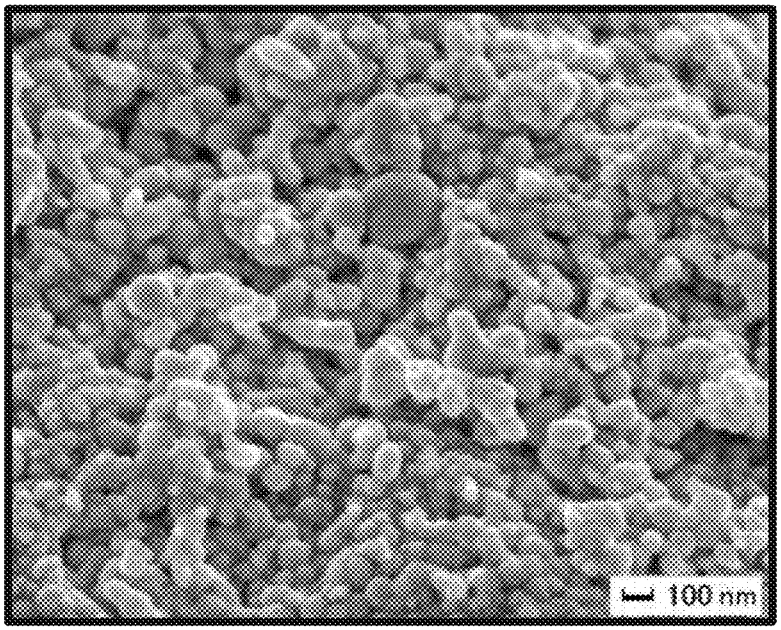
FIG. 6A is a view of a SEM image showing silver nanoparticles having a thin film formed of a hydrocarbon compound on surfaces thereof in Comparative Example 7.
Figure 6B:
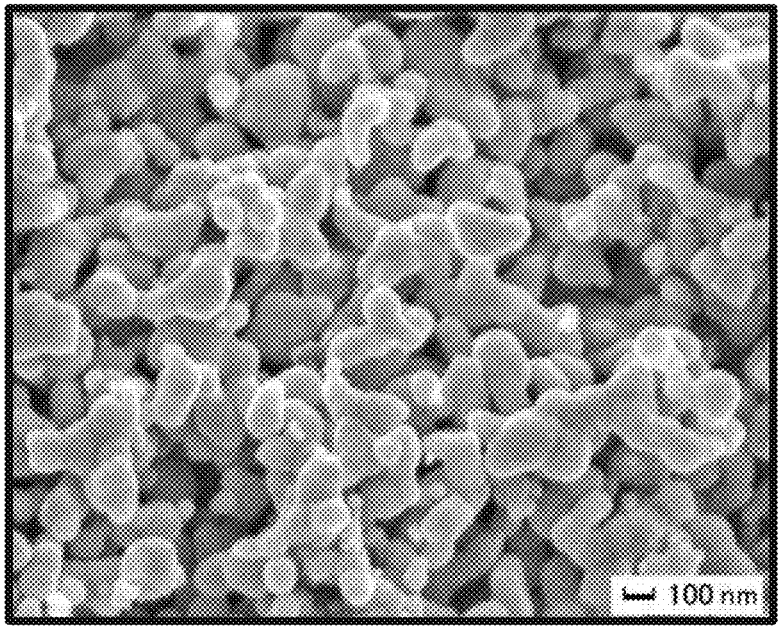
FIG. 6B is a view of a SEM image showing silver nanoparticles having a thin film formed of a hydrocarbon compound on surfaces thereof after being baked in Comparative Example 7.

As to the silver nanoparticles of Comparative Example 6, comparison between the silver nanoparticles before being baked shown in FIG. 5A and the silver nanoparticles after being baked shown in FIG. 5B reveals that, although the particle size of the silver nanoparticles after being baked was not smaller than 100 nm, the particles have not apparently bonded to one another.

The silver nanoparticles of Comparative Example 7 before being baked had the particle size of nearly 100 nm. Comparison between the silver nanoparticles before being baked shown in FIG. 6A and the silver nanoparticles after being baked shown in FIG. 6B reveals that, although the particle size of the silver nanoparticle after being baked was not smaller than 100 nm, the particles have not apparently bonded to one another.

Accordingly, the silver nanoparticles having the particle size and the exothermic peak temperature in the differential thermal analysis within the ranges of the present invention can be baked at a lower temperature than that of the conventional art.

REFERENCE SIGNS LIST

10 nanoparticle production apparatus
12 plasma torch
14 material supply device
15 primary nanoparticles
16 chamber
18 nanoparticles (secondary nanoparticles)
19 cyclone
20 collecting section
22 plasma gas supply source
24 thermal plasma flame
28 gas supply device
30 vacuum pump

The invention claimed is:

1. Silver nanoparticles having a particle size of 65 nm to 80 nm, and having a thin film formed of a hydrocarbon compound on surfaces thereof, wherein an exothermic peak temperature in a differential thermal analysis is 140° C. to 155° C.

2. The silver nanoparticles according to claim 1, wherein a particle growth rate expressed as (d−D)/D (%) is at least 50%, provided that d refers to a particle size of the silver nanoparticles after being baked at 100° C. for an hour, and D refers to a particle size of the silver nanoparticles before being baked.

* * * * *